United States Patent [19]

Mayer et al.

[11] 4,184,508

[45] Jan. 22, 1980

[54] PLATE VALVE

[75] Inventors: Thomas E. Mayer, Tonawanda; Richard A. McCarthy; George Yokota, both of Amherst, all of N.Y.

[73] Assignee: Worthington Compressors, Inc., Holyoke, Mass.

[21] Appl. No.: 837,408

[22] Filed: Sep. 28, 1977

[51] Int. Cl.[2] ..... F16K 15/08

[52] U.S. Cl. ..... 137/512.1

[58] Field of Search ..... 137/512.1, 516.15, 516.17, 137/516.21, 516.23

[56] References Cited

U.S. PATENT DOCUMENTS

| | | | |
|---|---|---|---|
| 3,273,591 | 9/1966 | Stewart | 137/512.1 |
| 3,786,834 | 1/1974 | Garland | 137/512.1 X |

*Primary Examiner*—Robert G. Nilson

[57] ABSTRACT

A plate valve is presented in which flow losses are reduced and effective flow area is maximized by establishing a ratio of effective seat area (Fs) to area between the plates (Fb) such that Fs/Fb is between 0.4 and 0.8. The spacing between plates is higher compared to the width of the plates than in the prior art, and the width of the plates may decrease for plates of increasing diameter.

6 Claims, 2 Drawing Figures

PLATE VALVE

BACKGROUND OF THE INVENTION (1) Field of the Invention

The present invention relates to check or plate valves and particularly to minimizing pressure losses in one-way flow control valve assemblies. More specifically this invention is directed to check or plate valves and especially to such valves for use in reciprocating compressors. Accordingly, the general objects of the present invention are to provide novel and improved methods and apparatus of such character.

(2) Description of the Prior Art

Check or one-way flow control valves employing annular plates as the moving element or valve member are well known in the art. An example of such a prior art "plate" valve is shown in U.S. Pat. No. 3,656,500. Valves of the type disclosed in U.S. Pat. No. 3,656,500 find wide utility and, for example, are employed in both the inlets to and discharge lines from reciprocating compressors. In a typical reciprocating type compressor installation, there will be from two to sixteen valves per cylinder and thus a single compressor may have in excess of one hundred plate valves associated therewith. A failure of any one valve or movable plate will disable the entire compressor. Accordingly, reliability is a primary consideration in the design of a plate valve.

To briefly describe prior art plates valves of the type exemplified by U.S. Pat. No. 3,656,500, such devices have a seat member with a plurality of passages or ports therethrough. These passages or ports are of arcuate shape and are arranged in concentric circles to thereby effectively define a plurality of annular inlet ports to the valve chamber or chambers. A guard member faces the seat member and is also provided with through passages or ports which effectively define a plurality of concentric, annular discharge passages or ports in the valve. The discharge passages are at the opposite side of the valve chamber from the inlets and are radially displaced, i.e., staggered with respect to the inlet. The guard member is also provided with a plurality of recesses which receive biasing springs. Annular plate or valve members, in the form of metallic or nonmetallic sealing strips, are located in the valve chamber intermediate the seat and guard. These sealing strips or plates, which have a width exceeding the width of the ends of the inlet ports, are constrained so as to be in alignment with the inlet ports. The plates are resiliently biased, by means of the aforementioned springs, against the seat whereby the valve will be normally closed. When the forces on the plates resulting from the applied pressure exceed the spring bias, the plates will move away from the seat and fluid may flow through the valve from the valve inlet passages to the valve discharge passages. Since there is an offset of the discharge passages with respect to the inlets, there is a change in direction of flow of the fluid as it passes through the valve.

While generally having adequate reliability, prior art plate valves have been characterized by comparatively large pressure losses. These pressure losses reduce the efficiency of compression and, if a given output pressure is required, the energy input to the compressor must be increased sufficiently to compensate for the losses. The problem of pressure losses is particularly acute in the case of compressors operating at low overall pressure ratios; i.e., pressure ratios in the range of 1.5–2.5/1. Compressors employed on natural gas pipelines are characterized by a low overall pressure ratio and it is of critical importance to minimize the energy consumption of such compressors incident to delivery of the gas under pressure to the consumer, especially when such compressors are powered by the very gas they are compressing.

It has, in the prior art, been universally believed that pressure losses in plate valves primarily occur at the seat area. Accordingly, in an effort to minimize such losses, it has previously been common practice to enlarge the seat area at the expense of the area between the annular plates. Thus, prior art plate valves have been characterized by sealing rings or plates having a width which was large when compared to the spaces between the rings. In a typical prior art plate valve the ratio of the sum of the seat areas ($\Sigma Fs$) to the sum of the areas between the plates ($\Sigma Fb$) (i.e. $\Sigma Fs/\Sigma Fb$) was 1.2. A further characteristic of prior art plate valves was that the sealing rings or plates were typically of equal width and, because of the above-discussed effort to minimize seat losses while ignoring any other losses, the rings were closely spaced. Also, prior plate valves intended for use in compressors operating at comparatively high speeds, i.e., compressors operated at 800–900 rpm, were designed with a lift which did not exceed 0.100 inches, since it has been generally considered that valves with lift exceeding 0.100 inches would not be reliable.

SUMMARY OF THE INVENTION

The present invention overcomes the above briefly discussed and other deficiencies and disadvantages of the prior art by providing a novel and improved check valve of the annular plate type. Valves in accordance with the present invention are characterized by a typical ratio of seat area to between the plate area ($\Sigma Fs/\Sigma Fb$) in the range of about 0.75. Valves in accordance with the present invention are also characterized by lifts which may exceed 0.11 inches at operating speeds over 800 rpm.

The present invention permits calculating the geometry of a plate valve of circular cross-section so as to optimize the valve efficiency for any given diameter valve. In achieving the foregoing, the present invention involves optimization of the seat losses, the losses between the plates, and the lift losses thereby minimizing the total pressure losses through the valve. Plate valves in accordance with the present invention are also characterized by annular plates having a width which decreases in proportion to the distance from the axis of the valve and by plates or sealing strips which are spaced further apart when compared with the prior art.

BRIEF DESCRIPTION OF THE DRAWING

The present invention may be better understood and its numerous objects and advantages will become apparent to those skilled in the art by reference to the accompanying drawing wherein like reference numerals refer to like elements in the two figures and in which.

DESCRIPTION OF THE PREFERRED EMBODIMENT

Figure 1:
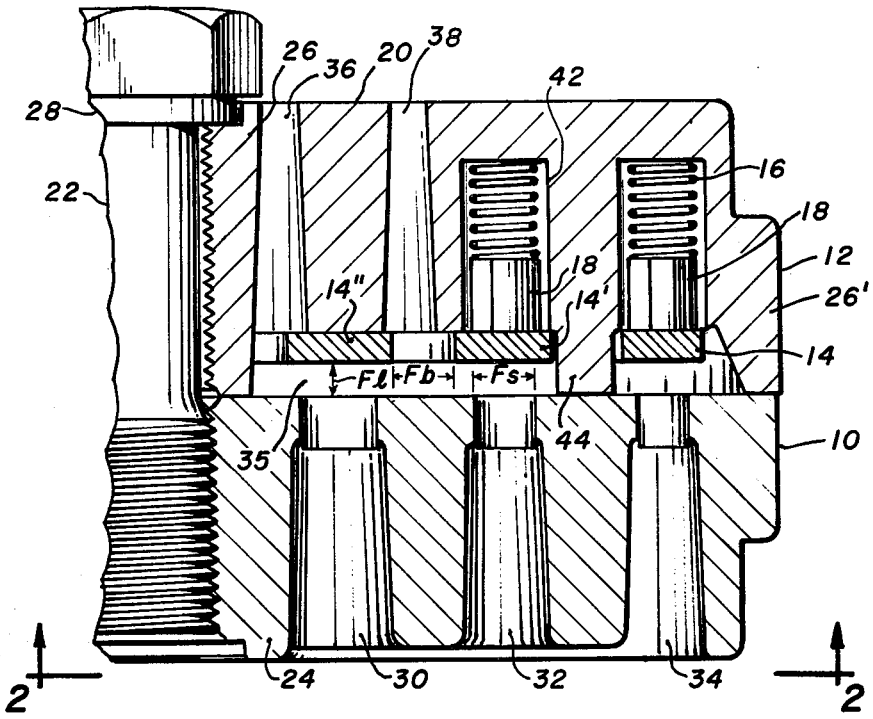
FIG. 1 is a partial cross-sectional side elevation view, taken on line 1—1 of FIG. 2, of a three element valve in accordance with a preferred embodiment of the present invention.
Figure 2:
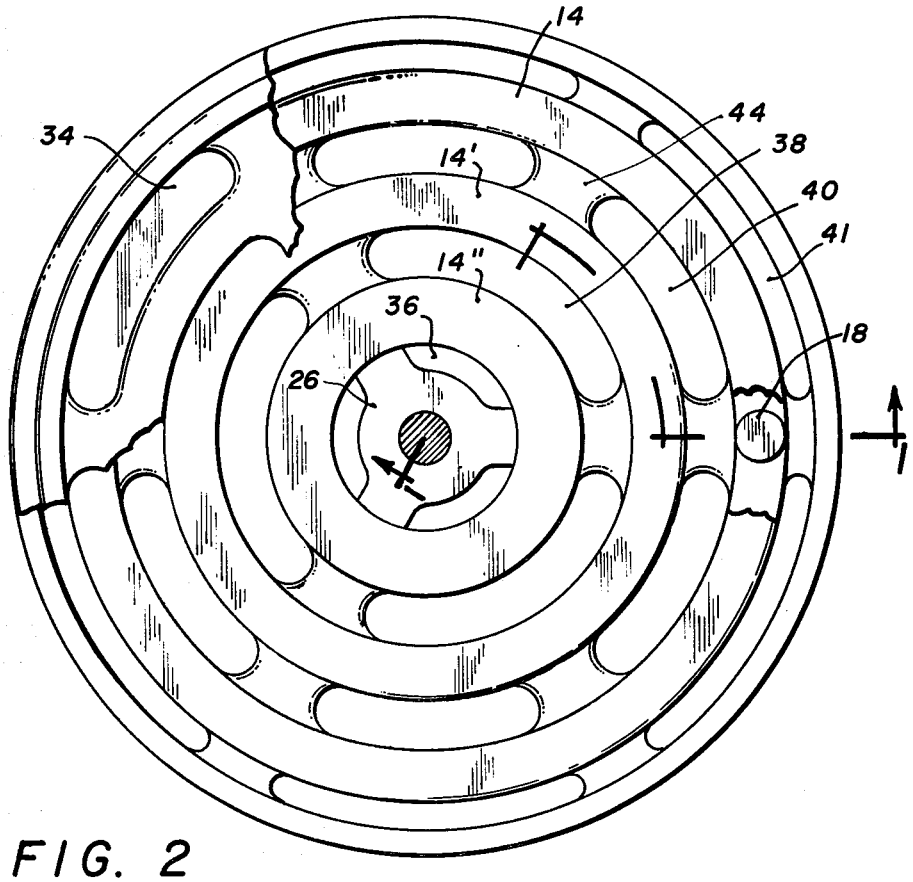
FIG. 2 is a bottom plan view on a reduced scale on line 2—2 of FIG. 1, partly broken away, of the valve of FIG. 1.

Referring to the drawing, a check valve particularly well suited for use in the inlet lines to and discharge lines from a reciprocating compressor is depicted. It will be understood that FIG. 1 is enlarged relative to FIG. 2, and only one-half of the valve is shown in FIG. 1, the total valve being radially symmetric about the center as shown in FIG. 2.

Because of the intended environment, the valve has a circular cross-sectional shape. The efficiency of a reciprocating compressor depends on the pressure loss incurred in flow through the inlet and discharge valves. Since the space available for the installation of the valves is limited, it is important that the valves provide the maximum effective flow area possible for a given total valve area. Considering the circular valve configuration of FIGS. 1 and 2, the total valve area is $(\pi/4)D^2$, where D is the overall diameter of the valve; and the effective flow area Feq is determined by the internal geometry of the valve and particularly by the sum of the seat areas Fs, the sum of the lift areas Fl and the sum of the areas between the sealing rings or plates Fb. Segments of the areas Fs, Fl and Fb have been labeled on FIG. 1. As used herein, and as understood in the art, the sum of the areas between the plates includes the total between the plate areas, such as the area indicated on FIG. 1 as Fb, and the area between the innermost plate 14" and ligament 26 and the area between outermost plate 14 and rim portion 26' of guard 12.

A plate valve in accordance with the disclosed embodiment of the present invention includes a seat member 10, a guard member 12 and a plurality of annular plates or sealing rings such as indicated at 14, 14' and 14". Plates 14, 14' and 14" will collectively be referred to as "14" unless distinctions are being made. The seat and guard will typically be comprised of cast iron machined as necessary to define the requisite passages, recesses and, in the case of seat 10, the flat seat surface which cooperates with the movable plates 14. The valve has been shown in FIG. 1 in the open condition wherein the pressure applied to the plates 14 exceeds the bias of compression springs, such as spring 16, which normally hold the valve closed. Springs 16 are spaced in annular arrays around the valve at each plate to urge the plates to their closed or seated postion. The force of the springs 16 is delivered to plates 14 via cylindrical buttons 18. The valve may also include a sleeve, such as sleeve 25 of FIG. 1 of U.S. Pat. No. 3,656,500, associated with each of springs 16. The valve may additionally include a coating of a suitable impact absorbing material, such as a polyimide, on the surfaces of the web members 20 which form the dividing walls between the annular discharge passages.

The seat 10 and guard 12 are each provided with an axial aperture whereby these elements of the valve may be joined together by means of a bolt 22 as shown. The structural ligament or center post 24 of seat 10 is threaded for engagement by bolt 22 whereas the structural ligament or post 26, surrounding the axial aperture in guard 12 is provided with a recessed lip or shoulder about its outwardly disposed end which receives a shoulder 28 integral with bolt 22.

The valve seat member is provided with arcuate passages which are arranged in concentric rings to thereby effectively define a plurality of annular inlets 30, 32 and 34. These inlets, with the valve installed in the compressor inlet or discharge line, will be connected to a common source of gas. The inlets 30, 32 and 34 taper inwardly toward the valve chamber 35. The ends of the inlets which discharge into valve chamber 35 decrease in radial width proceeding outwardly from the axis of the valve. That is, the discharge end of inlet 30 is wider than that of inlet 32 and the end of inlet 32 is wider than that of inlet 34.

The guard 12 is machined to define the valve chamber and to provide arcuate discharge passages which are arranged concentrically so as to effectively define annular discharges staggered in relation to the annular inlets. The discharge passages are indicated at 36, 38, 40 and 41. As noted, the discharge passages 36, 38, 40 and 41 are radially offset with respect to the inlets so the gas must turn in passing through the valve. The guard 12 is also provided with a plurality of cylindrical recesses 42 which are aligned with the inlets in seat member 10. There may, for example, be three recesses equally spaced about each annular region on the inwardly disposed side of guard 12 which is in alignment with an inlet in seat member 10. The recesses 42 receive the springs 16 and buttons 18. The guard 42 will also have, projecting downwardly into the valve chamber, a plurality of guides 44 for plates 14 and 14', while projections 45 on center post 26 guide plate 14".

The plates or valve members 14 are fabricated from a material which is lightweight while having adequate strength at the expected operating temperature of the valve. The material employed should, in addition, possess the ability to absorb impact, be of low density, have the ability to embed dirt in its surface and lack fatigue sensitivity to surface imperfections. Particularly suitable materials for use as the plates 14 are fiber reinforced plastics such as fiberglass reinforced nylon and asbestos reinforced Bakelite. The annular flat plates 14", 14' and 14, in contradistinction to prior art, decrease in width proceeding outwardly from the axis of the valve; i.e., the width of the plates is selected so as to be commensurate with the width of the ends of the inlets taking into account the need for an overlap. The decreasing width (in the radial direction) of the inlet flow orifices and the corresponding decreasing width of the plates from the center of the valve to the outer periphery of the valve serve to provide optimized flow with commonality of plates for multiple valve sizes. Also in contradistinction to the prior art, the plates 14 are spaced further apart than has been previous practice. The valve biasing springs 16 should be chosen to be as light as possible while still forcing the valve to close within a reasonable crank angle after dead center of the piston in the compressor cylinder with which the valve is associated.

The effective flow area Feq of the valve of the present invention is:

$$\frac{1}{Feq^2} = \frac{1}{(Ks\ Fs)^2} + \frac{1}{(Kb\ Fb)^2} + \frac{1}{(Kl\ Fl)^2} \qquad (1)$$

where Ks, Kb and Kl are experimentally or theoretically determined constants. The sum of the areas Fs and Fb is limited by the geometry of the valve. Thus, the sum of the areas Fs and Fb will be less than the area of the valve by an amount required to provide overlap of the moving plates 14 on the seat 10, to provide the structural ligaments such as ligament 26 and the outer rim portion 26' of the valve and to provide the guides 44. The magnitude of this inequality will depend on the service for which the valve is intended. Given the fixed values of Ks, Kl and Kb and the condition that Fs+Fb has a fixed maximum value for a given valve size, the maximum effective flow area for that valve size is obtained when:

$$\frac{Fs}{Fb} = \left(\frac{Kb}{Ks}\right)^{\frac{2}{3}} \quad (2)$$

Ks, the flow coefficient of the seat area, is larger than Kb, the flow coefficient of the between the plate area, because the flow enters the seat in an advantageously smooth manner from a region of relatively stagnant gas whereas gas enters the area between seat 10 and guard 12 by turning through a large angle from a direction approximately parallel to the surface of the seat. The flow separates from the surface at the edge of the plates 14 thereby resulting in the constant Kb being relatively low. A valve in accordance with the present invention typically has a ratio of the areas Fs/Fb which equals 0.75. Thus, in comparison with the prior art, the area Fb between the plates 14 will be enlarged and the area of the seats Fs will be decreased.

Once the seat area and area between the plates has been optimized, the lift area Fl may be increased by increasing the lift of the plates 14 or by employing a larger number of comparatively thin plates. The maximum lift that can be employed is limited by the dynamics of the plate-spring system and by the influence of the dynamics on valve reliability. Through use of a fiber reinforced plastic material for the plates, excellent reliability has been obtained with a lift of 0.140 inches. The increased lift, of course, enhances the effective flow area of the valve.

Using the concepts of the present invention, the optimum internal geometry of a valve (Fs, Fb, Fl inlet port widths, etc.) can be determined once the external diameter is known. This result is not possible with the prior art plate valve construction. While the prior art approach was to enlarge the seat area Fs at the expense of Fb to minimize seat losses while ignoring other losses, the present invention takes a much different approach. The present invention strives to diminish the total of the seat losses and the losses between the plates by maintaining the ratio Fs/Fb in the range of from 0.4 to 0.8.

In one compressor installation employing plate valves of the present invention in place of prior art plate valves, overall compressor efficiency was improved 20% and valve efficiency was improved 50%. Those improvements in compressor and valve efficiency are considerable and noteworthy.

While a preferred embodiment has been shown and described, various modifications and substitutions may be made thereto without departing from the spirit and scope of the present invention. Accordingly, it will be understood that the present invention has been described by way of illustration and not limitation.

What is claimed is:

1. A plate valve including:

valve seat means, said valve seat means having a flat seating surface and a first plurality of circumferentially arranged ports of arcuate shape spaced apart radially about an axis of the valve and intersecting said flat seating surface, the width of the ports of said first plurality varying, said first plurality of ports having a total effective flow area of Fs;

guard means coupled to said valve seat means, said guard means having a second plurality of circumferentially arranged ports of arcuate shape spaced apart radially about said valve axis and offset with respect to said ports in said valve seat means, said guard means and said valve seat means defining chamber means therebetween;

a plurality of concentric annular valve plates in said chamber, said valve plates being spaced apart radially about said valve axis and being aligned with said first plurality of ports, the sum of the areas between said valve plates being Fb, the ratio of Fs/Fb being in the range of 0.4 to 0.8; and means in said guard means for biasing said plates towards said valve seat means flat seating surface.

2. A plate valve as in claim 1 wherein:

said valve plates are of different widths.

3. A plate valve including:

valve seat means, said valve seat means having a flat seating surface and a first plurality of circumferentially arranged ports of arcuate shape spaced apart radially about an axis of the valve and intersecting said flat seating surface, said ports of said first plurality decreasing in width from the port closest to said valve axis to the port farthest removed from said valve axis, said first plurality of ports having a total effective flow area of Fs;

guard means coupled to said valve seat means, said guard means having a second plurality of circumferentially arranged ports of arcuate shape spaced apart radially about said valve axis and offset with respect to said ports in said valve seat means, said guard means and said valve seat means defining a chamber therebetween;

a plurality of concentric annular valve plates in said chamber, said valve plates being spaced apart radially about said valve axis and being aligned with said first plurality of ports, a sum of the areas between said valve plates being Fb, the ratio of Fs/Fb being in the range of 0.4 to 0.8; and means in said guard means for biasing said plates toward said valve seat means flat seating surface.

4. A plate valve as in claim 3 wherein:

said valve plates decrease in width from the valve plate closest to said valve axis to the valve plate furthest removed from said valve axis.

5. A plate valve including:

valve seat means, said valve seat means having a flat seating surface and a first plurality of circumferentially arranged ports of arcuate shape spaced apart radially about an axis of the valve and intersecting said flat seating surface, said first plurality of ports having a total effective flow area Fs, said ports of said first plurality decreasing in width from the port closest to said valve axis to the port farthest removed from said valve axis;

guard means coupled to said valve seat means, said guard means having a second plurality of circumferentially arranged ports of arcuate shape spaced apart radially about said valve axis and offset with respect to said ports in said valve seat means, said guard means and said valve seat means defining chamber means therebetween;

a plurality of concentric annular movable valve plates in said chamber, said valve plates being spaced apart radially about said valve axis and being aligned with said ports of said first plurality of ports, the sum of the between the valve plate areas being Fb, the ratio of Fs/Fb being in the range of 0.4 to 0.8 to optimize flow through different radial stations of said valve; and resilient means mounted in said guard means for biasing said valve plates toward said seat means flat seating surface.

6. A plate valve as in claim 5 wherein:

said valve plates decrease in width from the valve plate closest to said valve axis to the valve plate farthest removed from said valve axis.

* * * * *